US008336721B2

(12) United States Patent
Traldi

(10) Patent No.: US 8,336,721 B2
(45) Date of Patent: Dec. 25, 2012

(54) MODULAR DISPLAY UNIT FOR CYLINDRICAL PRODUCTS, IN PARTICULAR TUBES OF SWEETS

(75) Inventor: Ubaldo Traldi, Lainate (IT)

(73) Assignee: Perfetti van Melle S.p.A., Lainate (IT)

( * ) Notice: Subject to any disclaimer, the term of this patent is extended or adjusted under 35 U.S.C. 154(b) by 255 days.

(21) Appl. No.: 12/682,901

(22) PCT Filed: Sep. 30, 2008

(86) PCT No.: PCT/EP2008/008269

§ 371 (c)(1),
(2), (4) Date: Jun. 8, 2010

(87) PCT Pub. No.: WO2009/049767

PCT Pub. Date: Apr. 23, 2009

(65) Prior Publication Data

US 2010/0270248 A1 Oct. 28, 2010

(30) Foreign Application Priority Data

Oct. 15, 2007 (IT) ..... MI2007U0345 U

(51) Int. Cl.
*A47F 7/00* (2006.01)

(52) U.S. Cl. ..... 211/85.4; 211/60.1; 211/205

(58) Field of Classification Search ..... 211/85.4, 211/196, 205, 166, 133.4, 107, 36, 37, 62, 211/78, 70, 131.1, 68
See application file for complete search history.

(56) References Cited

U.S. PATENT DOCUMENTS

| | | | | | |
|---|---|---|---|---|---|
| 1,148,895 | A | * | 8/1915 | Gehl | 211/60.1 |
| 1,243,173 | A | * | 10/1917 | Hinckley | 211/62 |
| 1,700,579 | A | * | 1/1929 | Bassion | 211/62 |
| 2,614,698 | A | * | 10/1952 | Bell | 211/62 |
| 2,649,969 | A | | 8/1953 | Andrews | |
| 2,946,456 | A | | 7/1960 | Liguori | |
| 3,198,338 | A | | 8/1965 | McCormic | |
| 3,414,133 | A | * | 12/1968 | Guerri et al. | 211/107 |
| 3,489,289 | A | * | 1/1970 | Scott-Fenton | 211/78 |
| 4,305,511 | A | * | 12/1981 | Denholtz | 211/70 |
| 4,534,474 | A | * | 8/1985 | Ng | 211/70 |
| 4,795,710 | A | * | 1/1989 | Muszak et al. | 422/64 |

(Continued)

FOREIGN PATENT DOCUMENTS

DE 1 922 116 11/1970

(Continued)

OTHER PUBLICATIONS

International Search Report dated Feb. 11, 2009, from corresponding PCT application.

*Primary Examiner* — Jennifer E. Novosad
(74) *Attorney, Agent, or Firm* — Young & Thompson

(57) ABSTRACT

A display unit for cylindrical products, in particular tubes of sweets, includes at least one modular basket element 2, a support base 3 and a cover cap 4, the basket element including a perforated base part 5, an external shell 6 and a central tubular body shaped so as to allow stacking of several elements 2, the shell 6 having internally a plurality of concave seats 8 suitable for housing products 11 and forming externally convexities 9 separated by concave recesses 10.

7 Claims, 4 Drawing Sheets

U.S. PATENT DOCUMENTS

| | | | | | |
|---|---|---|---|---|---|
| 4,953,696 | A | * | 9/1990 | Huang et al. | 206/214 |
| D322,522 | S | * | 12/1991 | Ferris | D6/405 |
| 5,094,348 | A | * | 3/1992 | Harris et al. | 211/85.4 |
| D334,306 | S | * | 3/1993 | Breen | D6/455 |
| 5,361,915 | A | * | 11/1994 | Cohen et al. | 211/70.7 |
| 5,370,255 | A | * | 12/1994 | Yang | 220/4.27 |
| 5,894,944 | A | * | 4/1999 | Swift | 211/78 |
| D418,947 | S | * | 1/2000 | Greiner | D28/73 |
| 6,223,921 | B1 | * | 5/2001 | Huang | 220/4.27 |
| 6,561,363 | B1 | * | 5/2003 | Willhite et al. | 211/60.1 |
| 6,619,297 | B2 | * | 9/2003 | Sheng | 132/295 |
| D490,848 | S | * | 6/2004 | Pope et al. | D19/36 |
| 6,796,443 | B2 | * | 9/2004 | Lippman et al. | 211/131.1 |
| 6,837,386 | B1 | * | 1/2005 | Kent et al. | 211/153 |
| D562,031 | S | * | 2/2008 | Riesenberg | D6/476 |
| 7,395,939 | B2 | * | 7/2008 | Morris et al. | 211/65 |
| 7,980,387 | B2 | * | 7/2011 | Allen et al. | 206/214 |
| D650,861 | S | * | 12/2011 | Chuang | D19/77 |
| 2002/0134743 | A1 | * | 9/2002 | Keenan et al. | 211/85.4 |
| 2002/0139764 | A1 | * | 10/2002 | Hsu | 211/69.1 |
| 2003/0015486 | A1 | * | 1/2003 | Chen | 211/70 |

FOREIGN PATENT DOCUMENTS

| | | |
|---|---|---|
| GB | 2 409 666 | 7/2005 |

* cited by examiner

MODULAR DISPLAY UNIT FOR CYLINDRICAL PRODUCTS, IN PARTICULAR TUBES OF SWEETS

BACKGROUND OF THE INVENTION

1. Field of the Invention

The object of the present invention is a modular display unit for cylindrical products, in particular confectionary products and more particularly tubes of sweets, composed of modular elements.

The invention also relates to the modular element for the composition of the display unit.

2. Description of the Related Art

Display units for tubes of sweets are widespread yet each of them has at least some disadvantages, relating for example to filling of the same with the products, taking the products therefrom, the quantity of products contained in relation to the overall dimensions, the possibility of containing diversified products, and so on.

SUMMARY OF THE INVENTION

The present invention sets out to avoid these disadvantages, proposing a display unit for tubes of sweets which is modular in order to be able to spread out its capacity for containing so as to adapt to the various needs of the user, which allows easy filling with the products and equally easy taking of the same from any position, and allows the organised display of diversified products, which has limited overall dimensions and which can be assembled simply and rapidly.

The object is achieved by the display unit according to the invention which is composed of modular elements.

Substantially, the display unit according to the invention for cylindrical products, in particular tubes of sweets, comprises at least one modular element for stacking on an identical element and having the shape of a basket with a corrugated shell so as to form a plurality of seats for housing tubes with an arched profile, and a central tubular body which rises above the height of said shell.

The central tubular body has a conical shape with upward tapering, so that it can be inserted partially in the tubular body of an element above to allow stacking of the elements. Obviously the same result can be obtained by providing a widening at the base of the tubular element.

The shell of the basket instead has a conical shape with upward widening, in such a way that the tubes housed in the seats of the same are slightly tilted outwards so that they can be taken out easily.

In the case of stacking of several modular elements, the concave seats of one are arranged staggered in relation to those of the other, so that the tubes housed in an element below do not interfere with the convexity of the seats of the element above. The display unit likewise has a widened support base for greater stability and is completed by a cover cap.

BRIEF DESCRIPTION OF THE DRAWING FIGURES

Further features of the invention will be made clearer by the following detailed description relating to one of its embodiments given purely by way of a non-limiting example, illustrated in the accompanying drawings, in which.

DETAILED DESCRIPTION OF THE INVENTION

Figure 1:
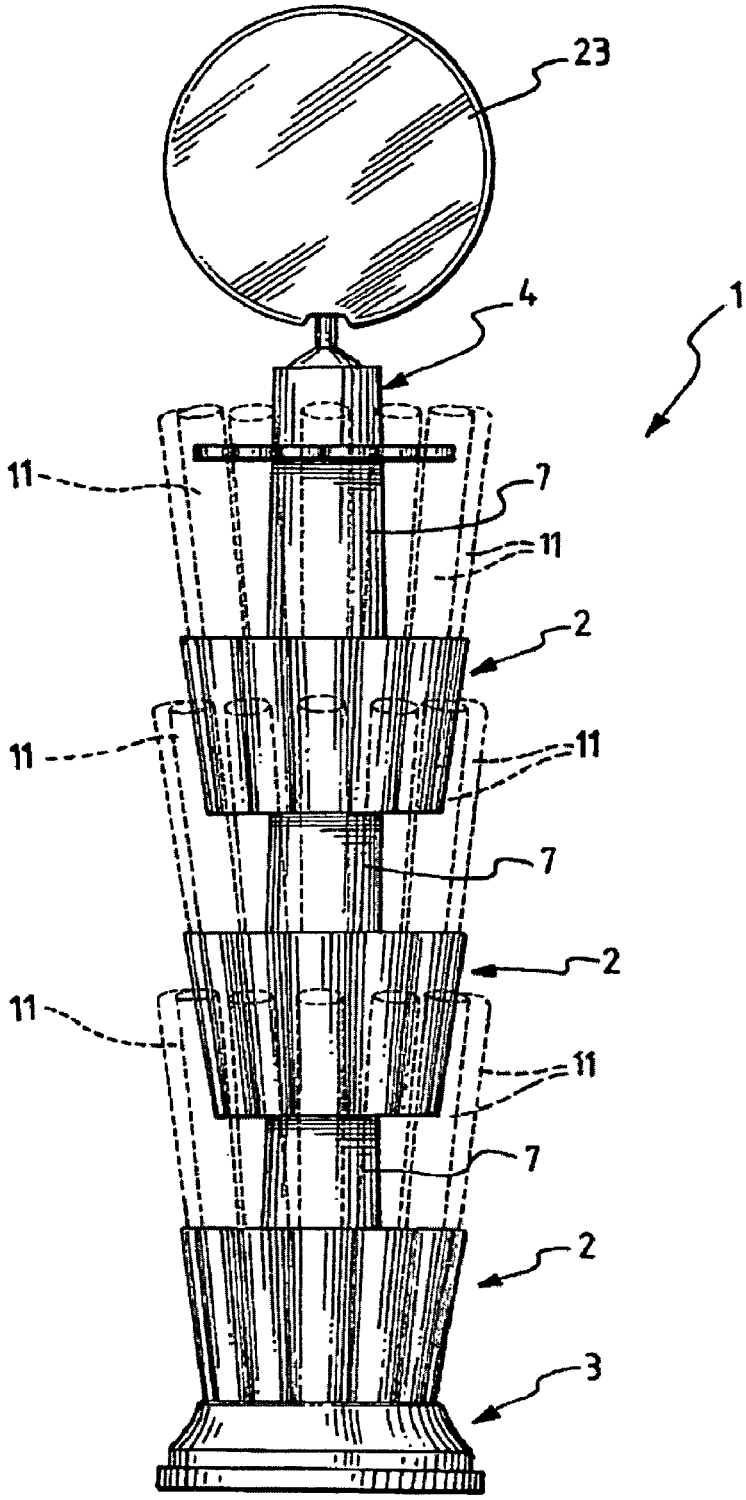
FIG. 1 is a front view of a display unit according to the invention, composed of four modular elements and complete with products.

Referring to these drawings, a description is now given of the display unit for cylindrical products, in particular confectionary products, and more particularly tubes of sweets, according to the invention, denoted overall by reference numeral 1.

It is composed of at least one and preferably a plurality of modular elements 2, whereto a support base 3 and a cover cap 4 can be attached.

The modular element 2, forming the basic component of the display unit 1, and which could act as a display unit on its own, has the configuration of a basket, having a base part 5 perforated centrally, a peripheral shell 6 *e* and a central tubular body 7 which rises up from the base 5, projecting considerably beyond the height of the shell 6.

Figure 2:
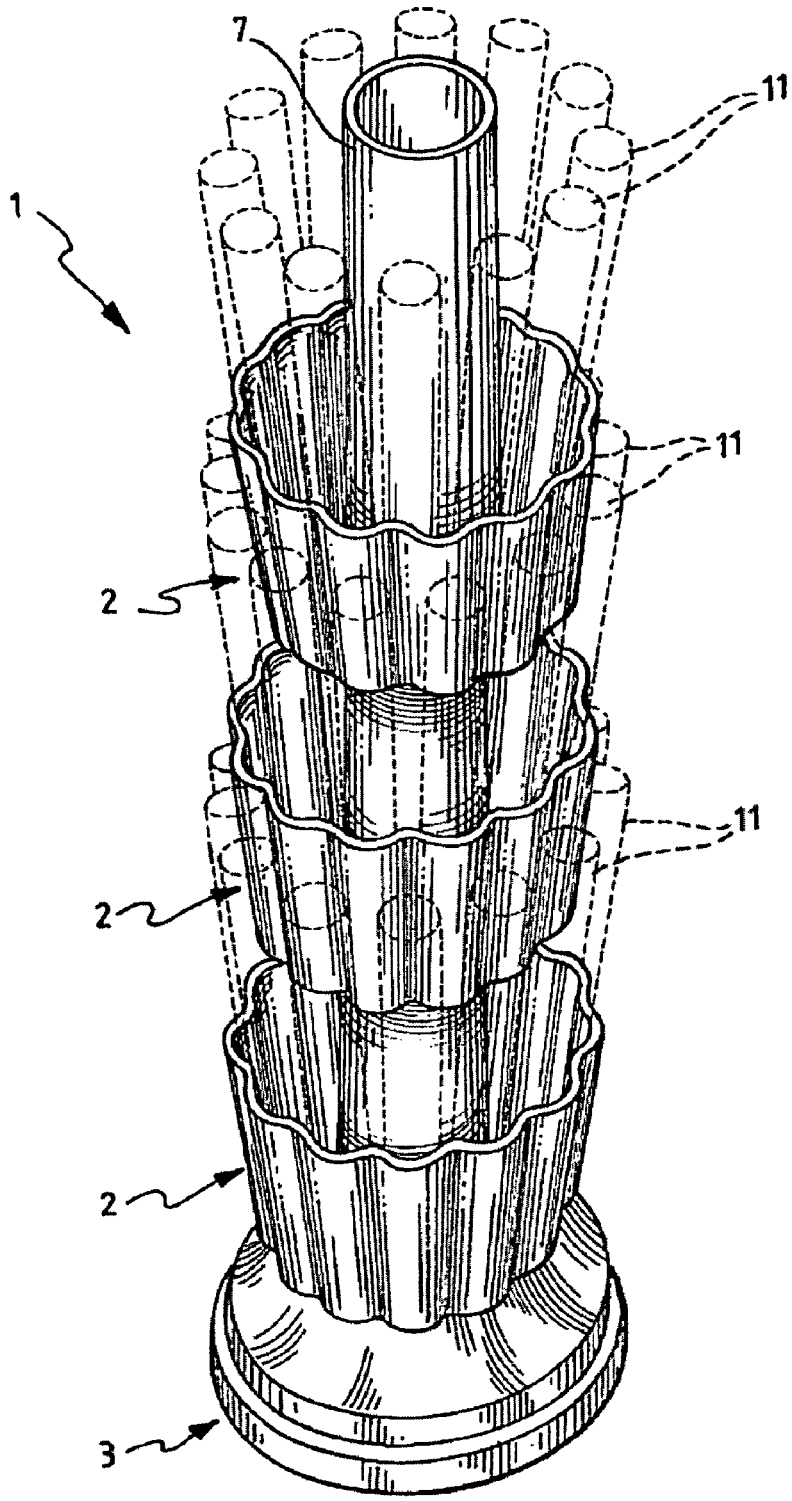
FIG. 2 is a perspective view from above of a display unit with three elements, with products and without the cover cap.
Figure 3:
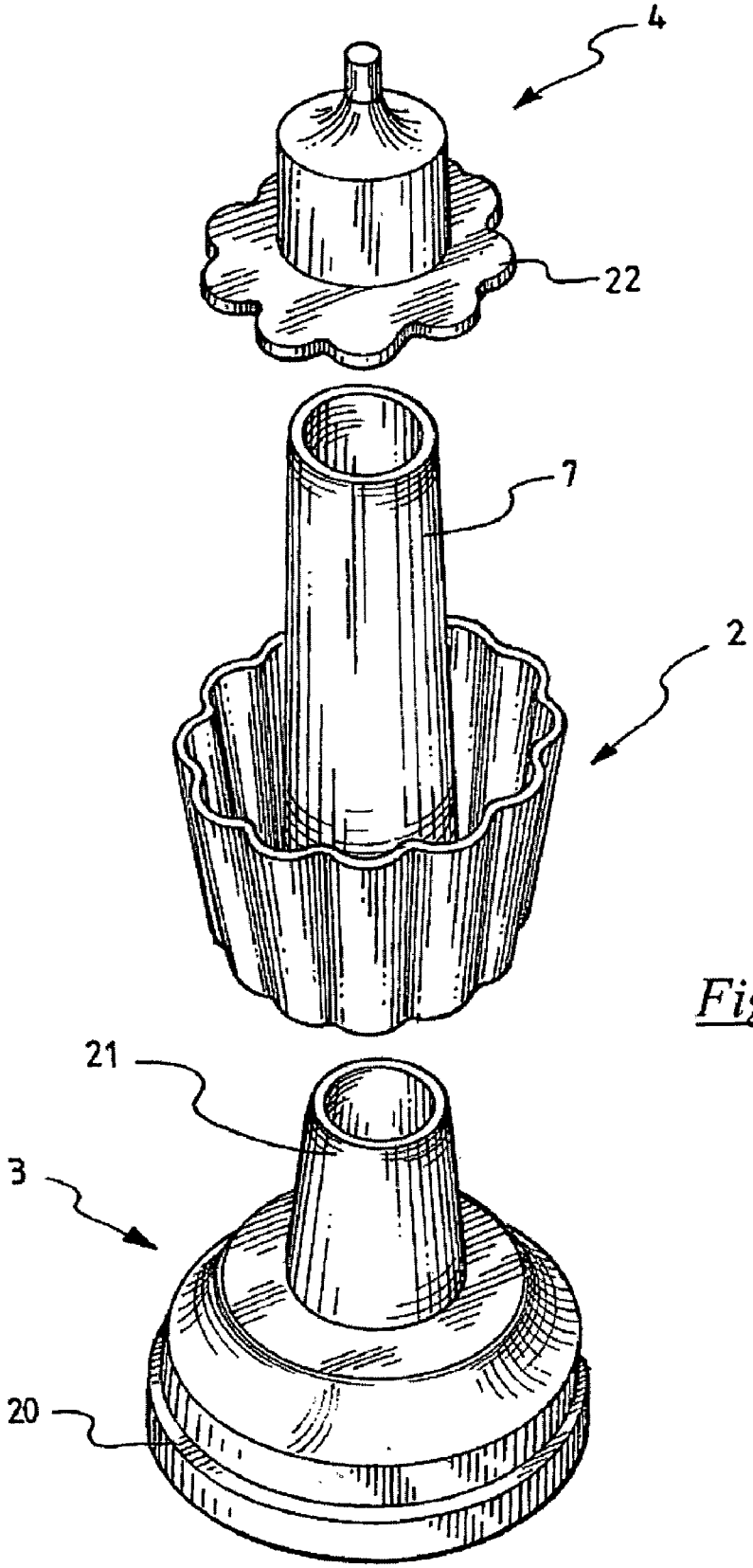
FIG. 3 is a blown-up view of the component parts of the display unit according to the invention: modular element, support base and cover cap.
Figure 4:
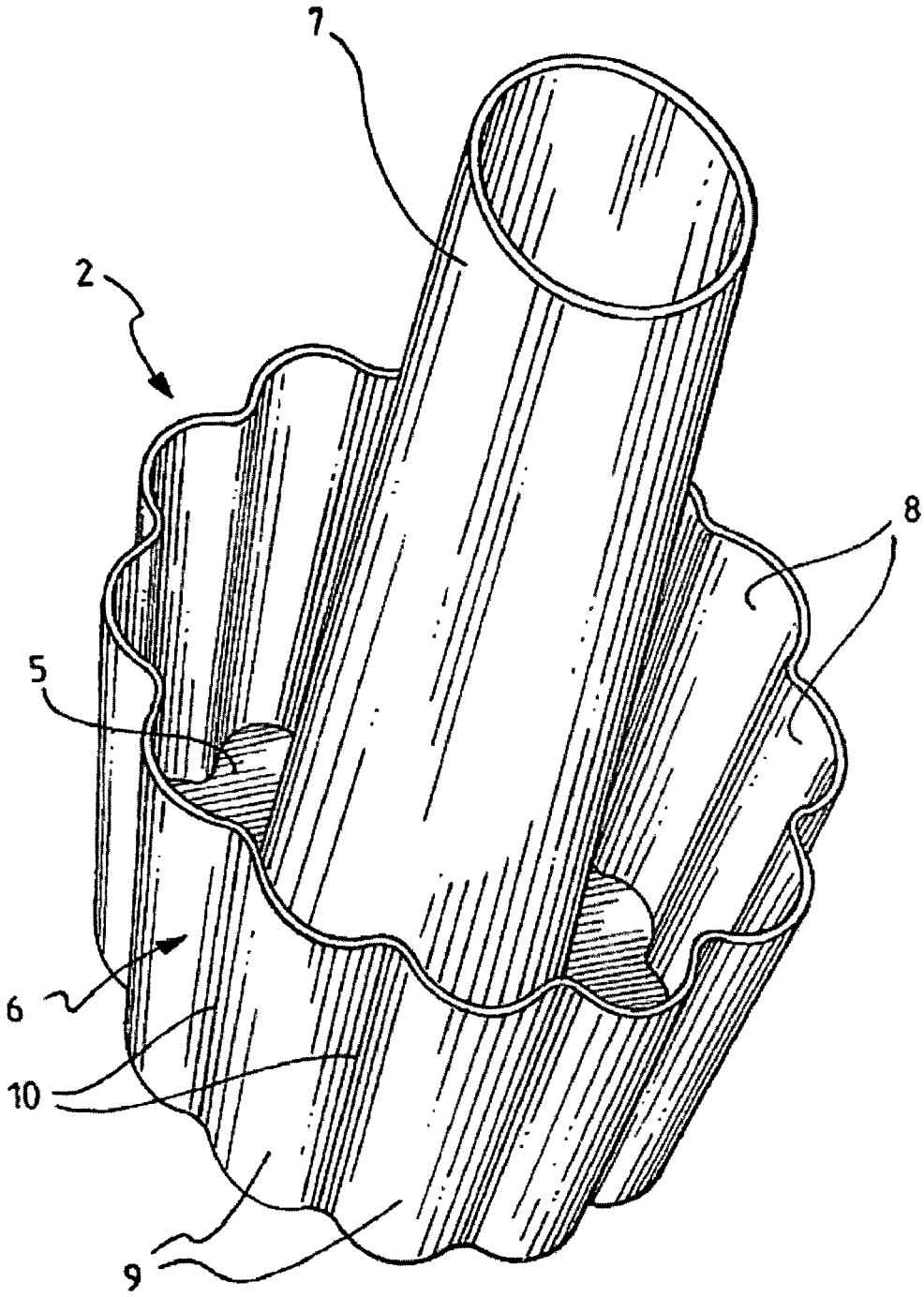
FIG. 4 is an enlarged perspective view from above of a modular element.

In the embodiment illustrated in the accompanying drawings the central tubular body 7 has a conical shape with upward tapering so that it can be inserted partially in the tubular body of an element 2 above, so as to allow the stacking of several elements and obtain the modular display unit 1 illustrated in FIGS. 1 and 2.

Obviously the stacking of the various elements 2 can be obtained by providing the cylindrical tubular body 7 with a widening at its base, so as to be able to house the upper section of the tubular body of a modular element below.

The shell 6 of the basket element 2 has a corrugated development so as to have internally a plurality of concave seats with a cylindrical profile 8, whereto the convexities 9 correspond externally, separated by concave recesses 10.

As can be seen in the drawings, the shell 6 splays upwards slightly so that the tubes of sweets 11 are arranged in the seats 8 with a slight tilt outwards, which makes it easier to remove them and prevents them from interfering with the shell of the basket above (FIGS. 1 and 2).

In this respect, in order to avoid the risk of this interference, in the composition of the display unit 1 the basket elements 2 are oriented and staggered one in relation to the other so that the internal seats 8, or the external convexities 9 of the shell of a basket element, are arranged aligned with the concave recesses 10 of the shell of the basket elements 2 above and below, so that the projecting sections of the tubes of sweets 11 are positioned at these recesses 10, without interfering with the convexities 9.

The support base 3 of the display unit has a widened body 20 for greater stability, from which a conical section 21 rises up, suitable for inserting in the tubular body 7 in the first modular basket element 2 of the display unit.

The display unit is then completed by the cover cap 34, also with a conical shape, which is attached at the end of the tubular body 7 of the last basket element 2, i.e. the uppermost one.

The cap 4 can have a corrugated projecting base 22, which can serve to hold in the correct position the tubes 11 in contact with it, as can be seen in FIG. 1.

In the embodiment of FIG. 1, a disk 23, with information on the products displayed, is attached to the cover cap 4.

The above description makes clear the advantages of the display unit for tubes of sweets according to the invention.

It can in fact be composed of any number of modular basket elements 2, in accordance with the spaces available, and allows 360° displaying of the tubes 11, which can also be arranged diversified in an organised fashion for each basket, and allow easy removal thanks to the tilting arrangement of the same and the considerable projection of the baskets.

Naturally the invention is not limited to the particular embodiment described previously and illustrated in the accompanying drawings and numerous detail modifications can be made thereto, within the reach of a person skilled in the art, without thereby departing from the sphere of the invention as defined by the following claims.

The invention claimed is:

1. A modular display unit for confectionary products in a form of tubes of sweets (11), comprising a plurality of modular basket elements (2) stacked one on other, each modular basket element (2) comprising:

a perforated central base (5);

a peripheral shell (6) which splays upwards; and a central tubular body (7) rising up from said base (5) and projecting beyond the height of the shell (6), said shell (6) extending around said central tubular body (7) and having a corrugated development defining a plurality of internal concave seats (8) suitable for housing said tubes of sweets (11), said seats (8) forming on the external surface of the shell (6) corresponding external convexities (9) separated by external concave recesses (10), wherein each modular basket element (2) has a staggered orientation in relation to the two basket elements stacked above and below, so that its seats (8) and the corresponding external convexities (9) are arranged aligned with the external concave recesses (10) of the shell (6) of the baskets stacked above and below, whereby the projecting portion of the tubes of sweets (11) housed in the seats of a basket element below are positioned at the external recesses (10) and do not interfere with the external convexities (9) of the basket element above.

2. The display unit according to claim 1, wherein said tubular body (7) has a conical shape tapering upwards.

3. The display unit according to claim 1, wherein said tubular body (7) has a cylindrical shape with widening at the base.

4. The display unit according to claim 1, also comprising a support base (3) and a cover cap (4).

5. The display unit according to claim 4, wherein said base (3) has a widened body (20) wherefrom a central body (21) rises up, suitable for inserting in the lowest modular basket element (2) of said plurality of basket elements of the display unit (1).

6. The display unit according to claim 4, wherein said cover cap (4) has a base projecting radially with a corrugated profile (22) which is adapted to hold in the correct position the tubes of sweet in contact with it.

7. The display unit according to claim 6, wherein an information disk (23) is attached to said cap (4).

* * * * *